US010034529B2

(12) United States Patent
Sanchez et al.

(10) Patent No.: US 10,034,529 B2
(45) Date of Patent: Jul. 31, 2018

(54) COSMETIC PRODUCT APPLICATOR INCLUDING A MASSAGE ELEMENT

(71) Applicant: L'OREAL, Paris (FR)

(72) Inventors: Marcel Sanchez, Aulnay sous Bois (FR); Audrey Thenin, Meudon (FR)

(73) Assignee: L'OREAL, Paris (FR)

( * ) Notice: Subject to any disclaimer, the term of this patent is extended or adjusted under 35 U.S.C. 154(b) by 220 days.

(21) Appl. No.: 14/779,096

(22) PCT Filed: Mar. 26, 2014

(86) PCT No.: PCT/EP2014/056063
§ 371 (c)(1),
(2) Date: Sep. 22, 2015

(87) PCT Pub. No.: WO2014/154749
PCT Pub. Date: Oct. 2, 2014

(65) Prior Publication Data

US 2016/0045011 A1 Feb. 18, 2016

(30) Foreign Application Priority Data

Mar. 27, 2013 (FR) ..... 13 52770

(51) Int. Cl.
*A45D 34/04* (2006.01)
*A45D 40/26* (2006.01)
*A45D 40/00* (2006.01)

(52) U.S. Cl.
CPC ..... *A45D 34/04* (2013.01); *A45D 34/046* (2013.01); *A45D 40/26* (2013.01); *A45D 40/261* (2013.01); *A45D 2040/0006* (2013.01)

(58) Field of Classification Search
CPC ..... A45D 2040/0006; A45D 34/04; A45D 34/041; A45D 34/046; A45D 40/26; A45D 40/261; A61H 15/0085; A61H 15/0092; A61H 2015/0007; A61H 2015/0042;
(Continued)

(56) References Cited

U.S. PATENT DOCUMENTS 4,846,159 A * 7/1989 Anzai ..... A61H 15/00 601/118
4,864,676 A * 9/1989 Schaiper ..... A46B 5/0012 15/104.94
(Continued)

FOREIGN PATENT DOCUMENTS

CN 101869386 A 10/2010
EP 1 080 659 A2 3/2001
(Continued)

*Primary Examiner* — Todd E Manahan
*Assistant Examiner* — Jennifer Gill
(74) *Attorney, Agent, or Firm* — Polsinelli PC

(57) ABSTRACT

This applicator comprises a base (22) and a product applicator tongue (25) that projects from the base (22) along an axis (A-A'), said tongue (25) defining a central cavity (30). It comprises a massage element (32) disposed in the central cavity (30), with the massage (32) element and the tongue (25) defining therebetween in the cavity (30) an intermediary product retaining space (33). The massage element (32) and the tongue (25) can move in relation to one another transversally in relation to the axis (A-A').

17 Claims, 1 Drawing Sheet

(58) Field of Classification Search
CPC ..... A61H 2015/005; A61H 2015/0064; A61H 2206/024
USPC ..... 132/218, 320; 601/112, 113, 34
See application file for complete search history.

(56) References Cited

U.S. PATENT DOCUMENTS 6,245,031 B1 * 6/2001 Pearson ..... A61H 15/0092 601/118
6,331,085 B1 12/2001 Schrepf et al.
7,174,596 B2 * 2/2007 Fischer ..... A46B 3/06 15/110
D638,987 S * 5/2011 Limongi ..... D28/7
D640,000 S * 6/2011 Limongi ..... D28/7
2002/0048482 A1 * 4/2002 Gueret ..... A45D 34/045 401/130
2010/0067969 A1 * 3/2010 Kang ..... A46B 11/0006 401/118
2011/0185520 A9 * 8/2011 Chan ..... A46B 15/00 15/110
2013/0048011 A1 * 2/2013 Bickford ..... A45D 34/041 132/320
2013/0255018 A1 * 10/2013 Xi ..... A46B 5/0029 15/105
2013/0276252 A1 * 10/2013 Xi ..... A46B 5/0029 15/105
2014/0037360 A1 * 2/2014 Hofmann ..... A45D 40/265 401/129
2014/0096787 A1 * 4/2014 Kim ..... A46B 5/0091 132/218
2016/0270514 A1 * 9/2016 Pires ..... A45D 40/265

FOREIGN PATENT DOCUMENTS

FR 2 895 887 A1 7/2007
WO WO-2011/001101 A3 2/2011

* cited by examiner

COSMETIC PRODUCT APPLICATOR INCLUDING A MASSAGE ELEMENT

CROSS REFERENCE TO RELATED APPLICATIONS

This application is a National Phase filing under 35 U.S.C. § 371 of PCT/EP2014/056063 filed on Mar. 26, 2014; and this application claims priority to Application No. 13 52770 filed in France on Mar. 27, 2013. The entire contents of each application are hereby incorporated by reference.

TECHNICAL FIELD

This invention relates to a cosmetic product applicator, including:

- a base;
- a product applicator tongue that projects from the base along an axis, said tongue defining a central cavity;
- a massage element disposed in the central cavity, with the massage element and the tongue defining therebetween in the cavity an intermediary product retaining space.

The cosmetic product is advantageously a liquid, cream or powder. It is intended to be applied on a surface of the body of a human, advantageously on the lips or cheeks. The cosmetic product is for example a makeup or care product.

More generally, "cosmetic product" means a product as defined in EC Regulation No 1223/2009 of the European Parliament and the Council of Nov. 30, 2009, relating to cosmetic products.

The applicator is, for example, mounted at the end of a rod of a gripping support. The gripping support is generally received in a cosmetic product reservoir in which the applicator soaks at rest.

BACKGROUND OF THE INVENTION

In a known manner, the applicator comprises a base intended to be inserted into the rod, and an application body forming a single piece with the base. In some cases, the application body is flocked.

For example FR 2 895 887 and FR 2 814 923 disclose applicators of the aforementioned type, for dispensing preferably mascara and nail varnish.

In the applicator described in FR 2 814 923, the application body defines a tubular cavity. A retaining element is fixed in the cavity and makes it possible to retain the product via capillarity.

The applicator is placed into contact with a surface of the body and the cosmetic product flows outside of the cavity to form a film on the surface of the body. The tubular walls of the cavity also make it possible to spread the product homogeneously over the surface of the body.

Such applicators allow for a simple and precise application for the user. However, they do not provide entire satisfaction, in that their functionality is limited to the application of a cosmetic product.

BRIEF SUMMARY OF THE INVENTION

A purpose of the invention is therefore to provide an applicator that improves the results of the application of the product, while increasing the application comfort that is associated with the applicator.

For this purpose, the invention has for object a cosmetic product applicator of the aforementioned type, wherein the massage element and the tongue can move in relation to one another transversally in relation to the axis.

According to particular embodiments, the cosmetic product applicator comprises one or several of the following characteristics taken in isolation or in any technically possible combination:

- the tongue defines a front face for applying the product, with the cavity opening into the front face, with the massage element able to be moved to a first configuration extracted away from the front face according to a first direction substantially normal to the front face;
- the tongue defines a rear face opposite the front face, with the cavity opening into the rear face opposite the front face, with the massage element able to be moved to a second extracted configuration according to a second direction substantially normal to the rear face;
- the massage element projects partially outside of the cavity over at least one side of the tongue in an idle configuration;
- the tongue comprises a peripheral region defining the central cavity, with the massage element having an end linked to one of the peripheral region and the base, and one free end projecting into the cavity;
- the massage element comprises a connection rod and an end protuberance with a radial span greater than that of the connection rod, with the protuberance being advantageously of spherical shape;
- the rigidity in bending of one of the tongue and of the massage element is less than the rigidity in bending of the other of the tongue and of the massage element;
- the tongue and/or the massage element are elastically urged towards an idle configuration;
- the massage element and the base form a single piece, with the tongue molded onto the single piece;
- the tongue and the massage element are from a single piece, being made from silicone and/or from a thermoplastic material;
- the inner cavity is extended along a longitudinal axis, with the massage element extending advantageously axially along the longitudinal axis;
- the tongue has a concave front face, with the cavity opening into the front face;
- the application body has an exterior flocking;
- the massage element and the tongue can move in relation to one another between an idle configuration in which at least one region of the massage element is received in the cavity and at least one extracted configuration wherein said region of the massage element is extracted outside of the central cavity of the tongue transversally with respect to the axis.

The invention also has for object a cosmetic product packaging and application device characterized in that it comprises:

- a cosmetic product reservoir comprising a neck;
- a gripping rod comprising a head able to cooperate with the neck;
- an applicator such as described hereinabove, with the base being mounted on the rod opposite the head.

The invention also relates to a method for applying cosmetic product on a surface of the body, including the following steps:

- provision of a device such as described above,
- output of the rod and of the applicator outside of the reservoir,
- application of the tongue and of the massage element on the surface of the body, depositing of the cosmetic product contained in the intermediary space on the surface of the body, and massage of the surface of the body by the passage of the massage element from an idle configuration to an extracted configuration.

BRIEF DESCRIPTION OF THE DRAWING(S)

The invention will be easier to understand in view of the following description, provided solely as an example and with reference to the appended drawings, wherein.

DETAILED DESCRIPTION

Figure 1:
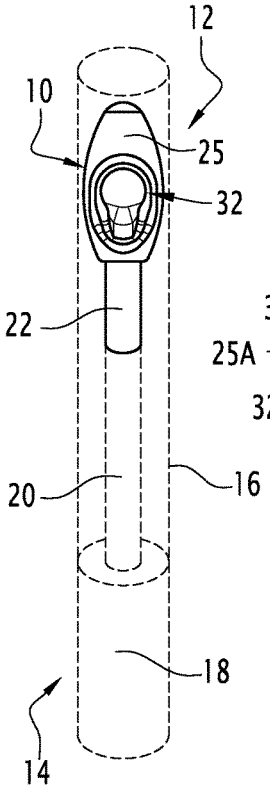
FIG. 1 is a perspective view of a cosmetic product application device, comprising a first applicator according to the invention.
Figure 2:
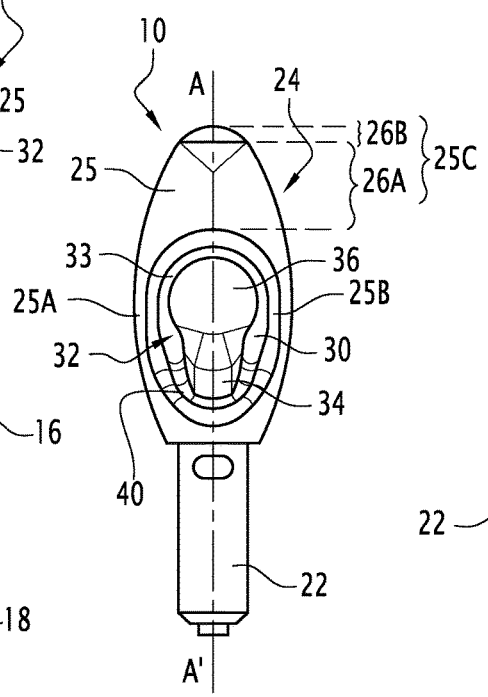
FIG. 2 is an enlarged front view of the applicator of FIG. 1.
Figure 3:
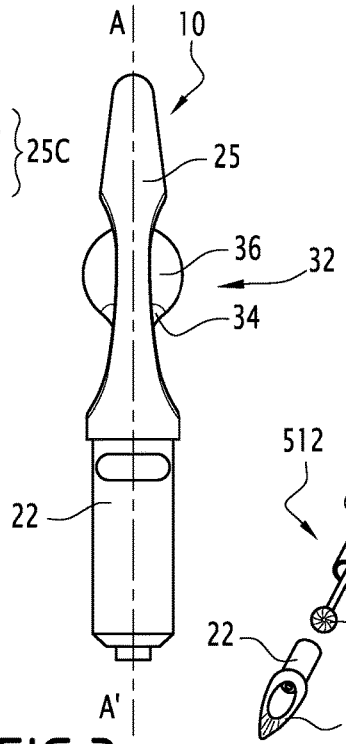
FIG. 3 is a side view of the applicator of FIG. 1.

A first cosmetic product applicator 10 mounted in an application device 12 is shown in FIGS. 1 to 3.

A device 10 is intended to apply a cosmetic product on a surface of the body of a user.

The cosmetic product is advantageously a liquid, cream or powder. It is intended to be applied on a surface of the body of a human, preferably on the lips or cheeks. The cosmetic product is for example a makeup or care product.

The application device 12 also comprises a gripping support 14 holding the applicator 10 and a cosmetic product reservoir 16.

In a known manner, the gripping support 14 comprises a handling member 18 intended to be gripped by a user and a rod 20 projecting from the handling member 18. Advantageously, the handling member 18 forms a cap sealing the reservoir 16.

The rod 20 is equipped at its free end with an axial housing for receiving the applicator 10.

The reservoir 16 contains the cosmetic product. It advantageously comprises a neck provided with a squeezing device (not shown) suitable for cooperating with the applicator 10 in order to remove the excess product from the applicator 10 when it is extracted from the reservoir 16.

As shown in FIGS. 2 and 3, the applicator 10 comprises a mounting base 22 able to be inserted into the gripping support 14 and a product application body 24 projecting from the gripping support 14.

The base 22 has a general shape revolving about a central axis A-A' shown vertically in FIGS. 2 et 3. In the example shown in FIGS. 2 and 3, the base 22 has a general cylindrical shape.

The application body 24 has in this example two median planes of symmetry, perpendicular in relation to one another. It as such comprises two identical faces and two identical sides.

The application body 24 has a front face and a rear face, with each one of the front face and the rear face able to come into contact with a surface of the body during use.

In the front view, the application body 24 has an elongated shape along the axis A-A'.

It comprises a tongue 25 that projects vertically from the base 22.

The tongue 25 comprises two lateral arms 25A and 25B, symmetrical with one another in relation to the central axis A-A', and an end portion 25C.

The lateral arms 25A and 25B and the end portion 25C define an extended cavity 30.

The extended portion 25C comprises a first proximal segment 26A and a second distal end segment 26B.

In this example, the distal section 26B has a convexity directed away from the base 22. Its center of curvature 27 is located on the axis A-A'.

The arms 25A and 25B and the end portion 25C define exteriorly the cavity 30 at its periphery. Each arm 25A, 25B advantageously has a minimum transverse span, taken perpendicularly to the axis A-A', less than the maximum transverse span of the cavity 30.

From the side view, the tongue 25 has on the lateral arms 29A and 29B two concave regions away from the axis A-A', which are located on either side of the axis A-A'.

The thickness of each arm 29A, 29B taken opposite the cavity 30 less than the thickness of the proximal section 26A.

The tongue 25 further has, from the side view, a general shape that converges towards the axis A-A' by displacing away from the base 22.

Furthermore, the application body 24 comprises a massage member 32 located at the center of the cavity 30 and extending longitudinally along the axis A-A'. In the cavity 30, the tongue 25 and the massage element 32 define an intermediary product retaining space 33. In this example, the intermediary space 33 substantially has the shape of a horseshoe.

The massage element 32 comprises a connection rod 34 with a general shape revolving about an axis A-A'.

The connection rod 34 projects vertically from the base 22. The massage element 32 also comprises a protuberance 36, here of spherical shape, projecting vertically at the free end of the connection rod 34.

The maximum transverse span of the protuberance 36, taken perpendicularly to the axis A-A', is greater than the transverse span of the connection rod 34.

The protuberance 36 projects partially outside of the cavity 30 on either side of the thickness of the tongue 25.

The application body 24 is for example obtained by molding. It is made of a thermoplastic material or from silicone.

In FIGS. 2 and 3, the application body 24 is made by molding of a thermoplastic material, in a single piece.

The application body 24 is here equipped with an external flocking. The flocking is formed by a plurality of small fibers, attached on the exterior surface of the application body 24.

The tongue 25 and the connection rod 34 have between them an elastic junction zone 40.

According to the invention, the massage element 32 and the tongue 25 can be moved relative to each other between an idle configuration, and a first configuration extracted in a first transverse direction D1 and second configuration extracted in a second transverse direction D2.

In the idle configuration, the protuberance 36 is received in the cavity 30 by being advantageously aligned with the tongue 25 along the axis A-A'.

Advantageously, more than 50% of the volume of the protuberance 36 is inserted in the cavity 30.

In each configuration extracted, the protuberance 36 projects outside of the cavity 30 opposite each one of the faces of the tongue 25 in a direction D1, D2 substantially perpendicular to each one of the faces.

Advantageously, about 25% of the volume of the protuberance 36 remains inserted in the cavity 30.

As such, at least one region of the massage element 32 located in the cavity 30 in the idle configuration is extracted outside of the cavity 30 in each configuration extracted.

The junction zone 40 is then deformed elastically. It elastically applies a force to the massage 32 and/or the tongue 25 towards the idle configuration.

In the first extracted configuration, the massage element 32 was extracted from the front face of the body 24 along a first direction D1 substantially transverse in relation to the axis A-A'.

In the second extracted configuration, the massage element 32 was extracted from the rear face of the body 24, along a second direction D2 opposite the direction D1.

In the absence of external mechanical stress, the applicator 10 retains its idle configuration, due to the elastic behavior of the junction zone 40.

The operation of the first applicator 10 according to the invention will now be described.

Initially, the user extracts the applicator 10 filled with cosmetic product from the reservoir 16, using the gripping support 14. The cosmetic product is retained in the intermediary space 33 of the cavity 30, but also on the flocking present on the external surface of the application body 24.

Then, the user directs the application body 24 towards a surface of the body, in particular towards a lip or a cheek, and applies the tongue 25 on the surface of the body to apply thereon the cosmetic product.

Then, the user directs the handling member 18 so as to move the application body 24 on the surface of the body in the application zone of the cosmetic product.

The successive presses of the application body 24 and of the massage element 32 against the surface of the body provoke the passages of the massage element 32 from the idle configuration towards each extracted configuration, allowing for a massage of the surface of the body of the user.

The applicator 10 is therefore particularly simple to use, and allows for a homogeneous and sufficient application of the product on a surface of the body, while still provoking a massage of the surface of the body.

This causes a pleasant tactile effect that is added to the primary functionality of the applicator.

Figure 4:
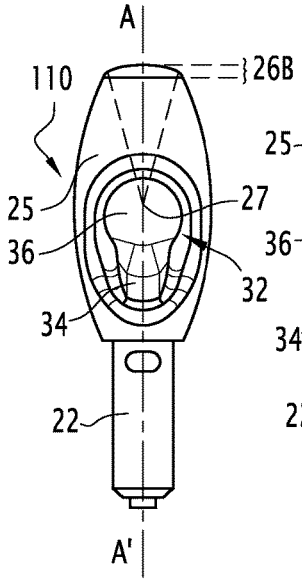
FIGS. 4 to 6 are front views of various applicators according to the invention.

A second applicator 110 according to the invention is shown in FIG. 4.

Unlike the applicator 10 shown in FIGS. 1 to 3, the distal section 26B of the applicator 110 has a different curvature, resulting in a position of the center of curvature 27 on the axis A-A' further from the end of the distal section 26B. As such, for the applicator 110, the curvature of the distal section 26B is greater than that of the applicator 10.

The end of the applicator 110, wider than that of the applicator 10, allows for a rapid application of the cosmetic product and facilitates spreading over large surfaces.

Figure 5:
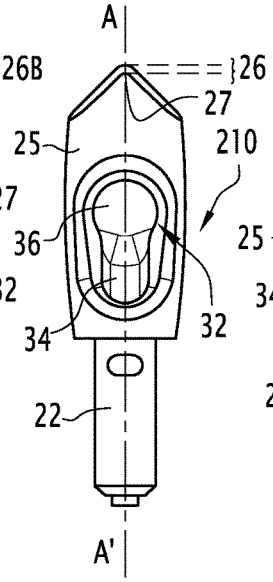

A third applicator 210 according to the invention is shown in FIG. 5.

As for the applicator 110, the distal section 26B of the applicator has a convexity that is different from that of the applicator 10. Its center of curvature 27 is still located on the axis A-A'. However, unlike the applicator 110, the center of curvature 27 is closer to the end of the distal section 26B in relation to the applicator 10. The section 26B of the applicator 210 has as such the shape of a point that is finer than that of the applicator 10.

The end of the applicator 210, narrower, allows for a precise application, for retouching and/or a finishing contour of the lips for example.

Figure 6:
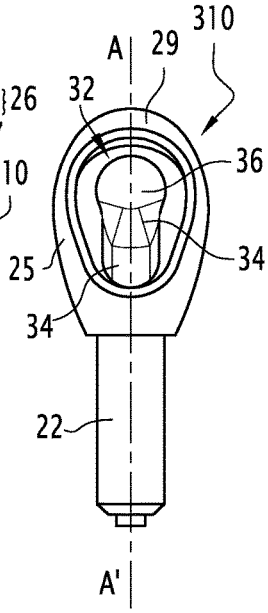

A fourth applicator 310 according to the invention is shown in FIG. 6.

Unlike the applicator 10, the massage element 32 and the base 22 of the applicator 310 are made integrally in a single piece by machining or molding, from plastic or silicone. The tongue 25 is then injection molded around the massage element 32. The tongue 25 is for example made of plastic or of silicone.

This makes it possible to obtain different rigidities in bending for the tongue 25 and the massage element 32. For example, the tongue 25 is flexible to the touch and can be deformed in bending about an axis perpendicular to the axis A-A', in relation to the massage element 32 that is rigid and embedded on the base 22.

Moreover, the end portion 25C of the applicator 310 is rounded.

The applicator 310 authorizes relative displacements that are more substantial between the massage element 32 and the tongue 25, providing for the user an amplified massage effect during the application of the cosmetic product.

Figure 7:
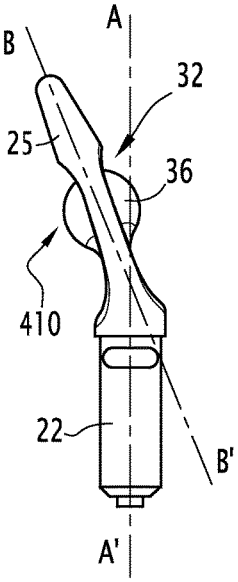
FIG. 7 is a profile view of a another applicator according to the invention.

A fifth applicator 410 according to the invention is shown in FIG. 7.

The applicator 410 is differentiated from the applicator 10 by the fact that the application body 24 and the base 22 of the applicator 410 no longer extend longitudinally along the same axis A-A'.

The application body 24 of the applicator 410 extends axially along an axis B-B' and the base 22 of the applicator 410 extends axially along the axis A-A'. The axes A-A' and B-B' form between them a non-zero angle, and for example between 5° et 20°, for example 16°.

This applicator 410 therefore has a concavity that results from the misalignment of the application body 24 in relation to the base 22. In particular, during the application on the lips, the applicator 410 hugs the shapes of the lips and allows for easy application of the product, in particular on the upper lip.

Figure 8:
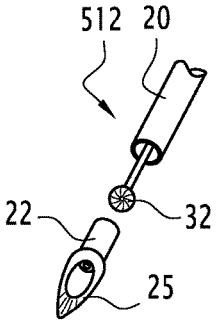
FIG. 8 is a partial perspective view of another cosmetic product application device according to the invention.

A second packaging device 512 according to the invention is shown in FIG. 8.

The device 512 is differentiated from the device 12 by the fact that the massage element 32 is integral with the rod 20. The tongue 25 and the base 22 are integral together.

Advantageously, the rod 20 and the massage element 32 are from a single piece. The base 22 and the tongue 25 made integral are inserted into the rod 20.

In this device, the massage element 32 is fixed in relation to the rod 20 and advantageously has the same rigidity as the rod 20. The tongue 25 is deformed during use.

The invention claimed is:

1. A cosmetic product applicator, of the type comprising:

a base;

a product applicator tongue that projects from the base along an axis (A-A'), said tongue defining a central cavity;

a massage element disposed in the central cavity, and wherein the massage element comprises a connection rod and an end protuberance with a radial span greater than that of the connection rod, with the protuberance being of spherical shape, and with the massage element and the tongue defining therebetween in the cavity an intermediary product retaining space;

wherein the massage element and the tongue can move in relation to one another transversally in relation to the axis (A-A');

wherein the tongue defines a concave front face for applying the product, with the cavity opening into the front face, with the massage element able to be moved to a first configuration extracted away from the front face according to a first direction (D1) substantially normal to the front face and wherein the tongue defines a concave rear face opposite the front face for applying the product, with the cavity opening into the rear face opposite the front face, with the massage element able to be moved to a second extracted configuration according to a second direction (D2) substantially normal to the rear face; and wherein the applicator further comprises an elastic junction zone between the product applicator tongue and the massage member configured to be deformed elastically and to apply a force to the massage element towards an idle configuration.

2. The applicator according to claim 1, wherein the massage element projects partially outside of the cavity over at least one side of the tongue in an idle configuration.

3. The applicator according to claim 2 wherein the tongue comprises a peripheral region defining the central cavity, with the massage element having an end linked to one of the peripheral region and the base, and one free end projecting into the cavity.

4. The applicator according to claim 1, wherein the tongue comprises a peripheral region defining the central cavity, with the massage element having an end linked to one of the peripheral region and the base, and one free end projecting into the cavity.

5. The applicator according to claim 1, wherein a rigidity in bending of one of the tongue and of the massage element is less than a rigidity in bending of the other of the tongue and of the massage element.

6. The applicator according to claim 1, wherein the tongue and/or the massage element are elastically urged towards an idle configuration.

7. The applicator according to claim 1, wherein the massage element and the base form a single piece, with the tongue molded onto the single piece.

8. The applicator according to claim 1, wherein the tongue and the massage element are from a single piece, being made from silicone and/or from a thermoplastic material.

9. The applicator according to claim 1, wherein the inner cavity is extended along the longitudinal axis (A-A'), with the massage element extending advantageously axially along the longitudinal axis.

10. The applicator according to claim 1, wherein the tongue or massage element has an exterior flocking.

11. The applicator according to claim 1, wherein the massage element and the tongue can move in relation to one another between an idle configuration in which at least one region of the massage element is received in the cavity and wherein in at least one extracted configuration said region of the massage element is extracted outside of the central cavity of the tongue transversally with respect to the axis (A-A').

12. A cosmetic product packaging and application device which comprises:

a cosmetic product reservoir comprising a neck;

a gripping rod comprising a head able to cooperate with the neck;

an applicator according to claim 1, with the base being mounted on the rod opposite the head.

13. A method for applying cosmetic product on the surface of the body, including the following steps:

provision of a device according to claim 12, output of the rod and of the applicator outside of the reservoir, application of the tongue and of the massage element on a surface of a body, depositing of the cosmetic product contained in the intermediary space on the surface of the body, and massage of the surface of the body by the passage of the massage element from an idle configuration to an extracted configuration.

14. A cosmetic product applicator, of the type comprising:

a base;

a product applicator tongue that projects from the base along an axis (A-A'), said tongue defining a central cavity;

a massage element disposed in the central cavity, and wherein the massage element comprises a connection rod and an end protuberance with a radial span greater than that of the connection rod, with the protuberance being of spherical shape, and with the massage element and the tongue defining therebetween in the cavity an intermediary product retaining space;

wherein the massage element and the tongue can move in relation to one another transversally in relation to the axis (A-A') and wherein the massage element projects partially outside of the cavity on either side of the tongue in an idle configuration; and wherein the applicator further comprises an elastic junction zone between the product applicator tongue and the massage member configured to be deformed elastically and to apply a force to the massage element towards an idle configuration.

15. The applicator according to claim 14, wherein the tongue comprises a peripheral region defining the central cavity, with the massage element having an end linked to one of the peripheral region and the base, and one free end projecting into the cavity.

16. A cosmetic product packaging and application device which comprises: a cosmetic product reservoir comprising a neck; a gripping rod comprising a head able to cooperate with the neck; an applicator according to claim 14, with the base being mounted on the rod opposite the head.

17. A method for applying cosmetic product on the surface of the body including the following steps: provision of a device according to claim 16, output of the rod and of the applicator outside of the reservoir, application of the tongue and of the massage element on a surface of a body, depositing of the cosmetic product contained in the intermediary space on the surface of the body, and massage of the surface of the body by the passage of the massage element from an idle configuration to an extracted configuration.

* * * * *